US010426303B2

(12) United States Patent
Son et al.

(10) Patent No.: US 10,426,303 B2
(45) Date of Patent: Oct. 1, 2019

(54) VACUUM CLEANER

(71) Applicant: LG ELECTRONICS INC., Seoul (KR)

(72) Inventors: Jungkyu Son, Seoul (KR); Bohyun Nam, Seoul (KR); Jaeyong Park, Seoul (KR); Sehwan Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 210 days.

(21) Appl. No.: 15/444,761

(22) Filed: Feb. 28, 2017

(65) Prior Publication Data

US 2017/0245703 A1 Aug. 31, 2017

(30) Foreign Application Priority Data

Feb. 29, 2016 (KR) ..... 10-2016-0024022
Mar. 25, 2016 (KR) ..... 10-2016-0036277
Dec. 30, 2016 (KR) ..... 10-2016-0184161

(51) Int. Cl.

| | |
|---|---|
| ***A47L 5/36*** | (2006.01) |
| ***A47L 9/10*** | (2006.01) |
| ***A47L 9/12*** | (2006.01) |
| ***A47L 9/24*** | (2006.01) |
| ***A47L 9/00*** | (2006.01) |
| ***A47L 9/28*** | (2006.01) |

(52) U.S. Cl.

CPC ..... *A47L 5/362* (2013.01); *A47L 9/009* (2013.01); *A47L 9/0081* (2013.01); *A47L 9/102* (2013.01);

(Continued)

(58) Field of Classification Search

CPC ..... A47L 5/362; A47L 9/242; A47L 9/0081; A47L 9/009; A47L 9/102; A47L 9/2884;

(Continued)

(56) References Cited

U.S. PATENT DOCUMENTS 2,811,737 A 11/1957 Hayba
4,831,683 A 5/1989 Kroll et al.

(Continued)

FOREIGN PATENT DOCUMENTS

CN 1698527 11/2005
CN 101554306 10/2009

(Continued)

OTHER PUBLICATIONS

International Search Report in International Application No. PCT/KR2017/002143, dated Jun. 27, 2017, 3 pages (with partial English translation).

(Continued)

*Primary Examiner* — David Redding
(74) *Attorney, Agent, or Firm* — Fish & Richardson P.C.

(57) ABSTRACT

A vacuum cleaner that includes: a suction hose; and a cleaner main body including: a main body portion, a suction motor that is configured to generate suction force, a dust container that includes (i) a storage space to collect dust and (ii) a suction port through which dust is collected from the suction hose into the storage space, and a cover member (i) that is configured to rotate, about an axis that is outside of a plane of the cover member, between a first position and a second position, (ii) that covers, based on the cover member being located at the first position, at least a portion of the dust container, and (iii) that includes a coupling unit that couples the suction hose to the suction port, wherein, based on the cover member being located at the first position, the coupling unit aligns with the suction port is disclosed.

19 Claims, 14 Drawing Sheets

(52) U.S. Cl.
CPC ..... *A47L 9/12* (2013.01); *A47L 9/242* (2013.01); *A47L 9/2805* (2013.01); *A47L 9/2852* (2013.01); *A47L 9/2857* (2013.01); *A47L 9/2884* (2013.01)

(58) Field of Classification Search
CPC .... A47L 9/2805; A47L 9/2852; A47L 9/2857; A47L 9/12; A47L 5/36; A47L 9/24
USPC ..... 15/327.7, 414
See application file for complete search history.

(56) References Cited

U.S. PATENT DOCUMENTS

| | | | |
|---|---|---|---|
| 4,962,453 | A | 10/1990 | Pong et al. |
| 5,839,156 | A | 11/1998 | Park et al. |
| 5,926,909 | A | 7/1999 | McGee et al. |
| 5,991,972 | A | 11/1999 | Krebs et al. |
| 6,226,830 | B1 | 5/2001 | Hendriks et al. |
| 7,637,973 | B2 | 12/2009 | Oh et al. |
| 8,062,398 | B2 * | 11/2011 | Luo ..... A47L 5/362 15/347 |
| 8,272,854 | B2 | 9/2012 | Castronovo |
| 8,613,125 | B2 | 12/2013 | Jeong et al. |
| 9,089,248 | B2 | 7/2015 | Yoo |
| 9,820,623 | B2 | 11/2017 | Ha |
| 9,958,031 | B2 | 5/2018 | Park et al. |
| 2003/0140444 | A1 | 7/2003 | Soejima |
| 2005/0102790 | A1 | 5/2005 | Matsuno et al. |
| 2008/0155768 | A1 | 7/2008 | Ziegler et al. |
| 2008/0235901 | A1 | 10/2008 | Tanaka et al. |
| 2010/0132149 | A1 | 6/2010 | Jeong et al. |
| 2013/0212829 | A1 | 8/2013 | Yoon et al. |
| 2014/0359967 | A1 | 12/2014 | Park |
| 2015/0223652 | A1 | 8/2015 | Koura et al. |
| 2015/0320283 | A1 | 11/2015 | Lee et al. |
| 2017/0027400 | A1 | 2/2017 | Lee et al. |
| 2017/0245702 | A1 | 8/2017 | Son et al. |
| 2017/0245703 | A1 | 8/2017 | Son et al. |
| 2017/0245704 | A1 | 8/2017 | Son et al. |
| 2017/0245705 | A1 | 8/2017 | Son et al. |
| 2017/0245706 | A1 | 8/2017 | Son et al. |
| 2017/0245707 | A1 | 8/2017 | Son et al. |
| 2017/0245708 | A1 | 8/2017 | Son et al. |
| 2017/0245711 | A1 | 8/2017 | Son |
| 2017/0245712 | A1 | 8/2017 | Son et al. |
| 2017/0245713 | A1 | 8/2017 | Son et al. |
| 2017/0245714 | A1 | 8/2017 | Son et al. |
| 2017/0245715 | A1 | 8/2017 | Son et al. |
| 2017/0245716 | A1 | 8/2017 | Son et al. |
| 2017/0245717 | A1 | 8/2017 | Son et al. |
| 2017/0245718 | A1 | 8/2017 | Son et al. |
| 2017/0245719 | A1 | 8/2017 | Son et al. |
| 2017/0273529 | A1 | 9/2017 | Chung et al. |
| 2017/0354304 | A1 | 12/2017 | Kwak |
| 2018/0177360 | A1 | 6/2018 | Kwak |

FOREIGN PATENT DOCUMENTS

| | | | |
|---|---|---|---|
| CN | 102469901 | | 5/2012 |
| CN | 204169778 | | 2/2015 |
| CN | 204192512 | | 3/2015 |
| CN | 105078363 | | 11/2015 |
| EP | 319700 | A1 | 6/1991 |
| EP | 319700 | B1 | 6/1991 |
| EP | 1674009 | | 6/2006 |
| EP | 1848318 | | 10/2007 |
| EP | 2030543 | | 3/2009 |
| EP | 2063699 | | 6/2009 |
| EP | 2203101 | | 7/2010 |
| JP | H06102061 | | 12/1994 |
| JP | 7236599 | B1 | 9/1995 |
| JP | 11004787 | B1 | 1/1999 |
| JP | 2002028121 | | 1/2002 |
| JP | 2003019095 | | 1/2003 |
| JP | 2003038404 | | 2/2003 |
| JP | 2003093302 | | 4/2003 |
| JP | 2003169771 | | 6/2003 |
| JP | 2004033628 | | 2/2004 |
| JP | 2005211462 | | 8/2005 |
| JP | 2006263310 | B1 | 10/2006 |
| JP | 2006314569 | A | 11/2006 |
| JP | 2008301851 | B1 | 12/2008 |
| JP | 2010005341 | | 1/2010 |
| JP | 4553793 | B | 9/2010 |
| JP | 2011177268 | A | 9/2011 |
| JP | 2012192006 | | 10/2012 |
| JP | 2013066620 | | 4/2013 |
| JP | 2015-096132 | | 5/2015 |
| JP | 2015096132 | | 5/2015 |
| JP | 2015173673 | | 10/2015 |
| JP | 2016015974 | | 2/2016 |
| KR | 20-1989-0004031 | | 4/1989 |
| KR | 199210563 | B1 | 12/1992 |
| KR | 10-1997-0032722 | | 7/1997 |
| KR | 100449933 | | 4/1998 |
| KR | 100702733 | | 9/2001 |
| KR | 200294697 | | 10/2002 |
| KR | 10-2005-0064945 | | 6/2005 |
| KR | 2006062196 | B1 | 6/2006 |
| KR | 10-2006-0082900 | | 7/2006 |
| KR | 2006074612 | B1 | 7/2006 |
| KR | 10-2010-0123861 | | 9/2006 |
| KR | 10-2006-0118185 | | 11/2006 |
| KR | 100640830 | | 11/2006 |
| KR | 100662282 | | 12/2006 |
| KR | 10-0702733 | | 4/2007 |
| KR | 10-2007-0106864 | | 11/2007 |
| KR | 100807409 | | 2/2008 |
| KR | 829094 | B1 | 5/2008 |
| KR | 100831784 | | 5/2008 |
| KR | 100840889 | | 6/2008 |
| KR | 10-2008-0099370 | | 11/2008 |
| KR | 869537 | B1 | 11/2008 |
| KR | 100876695 | | 11/2008 |
| KR | 1020080099373 | | 11/2008 |
| KR | 10-0876695 | | 12/2008 |
| KR | 10-2010-0019146 | | 2/2010 |
| KR | 10-2010-0021700 | | 2/2010 |
| KR | 2010047638 | B1 | 5/2010 |
| KR | 10-2010-0104621 | | 9/2010 |
| KR | 2010116834 | B1 | 11/2010 |
| KR | 101026065 | | 3/2011 |
| KR | 10-2012-0004100 | | 1/2012 |
| KR | 101166285 | | 7/2012 |
| KR | 10-2012-0118643 | | 10/2012 |
| KR | 10-2013-0029852 | | 3/2013 |
| KR | 10-2014-0144568 | | 12/2014 |
| KR | 101495732 | | 2/2015 |
| KR | 10-2015-0031304 | | 3/2015 |
| KR | 2015033554 | B1 | 4/2015 |
| KR | 101524797 | | 6/2015 |
| KR | 10-1552437 | | 9/2015 |
| KR | 101552437 | | 9/2015 |
| KR | 1666902 | B1 | 10/2016 |
| KR | 2017000071 | B1 | 1/2017 |
| TW | 529406 | | 4/2003 |
| TW | 572746 | | 1/2004 |
| TW | I240622 | | 10/2005 |
| TW | 201402058 | | 1/2014 |
| TW | 201513821 | | 4/2015 |
| WO | WO2004032696 | | 4/2004 |
| WO | 2010128922 | | 11/2010 |
| WO | 2016208944 | A | 12/2016 |

OTHER PUBLICATIONS

International Search Report in International Application No. PCT/KR2017/001335, dated Apr. 26, 2017, 3 pages (with partial English translation).

International Search Report in International Application No. PCT/KR2017/002148, dated Jul. 6, 2017, 3 pages (with partial English translation).

(56) References Cited

OTHER PUBLICATIONS

International Search Report in International Application No. PCT/KR2017/002151, dated Jul. 6, 2017, 3 pages (with partial English translation).
International Search Report in International Application No. PCT/KR2017/002152, dated Jun. 27, 2017, 3 pages (with partial English translation).
International Search Report in International Application No. PCT/KR2017/002155, dated Jun. 23, 2017, 3 pages (with partial English translation).
International Search Report in International Application No. PCT/KR2017/002156, dated Jul. 5, 2017, 3 pages (with partial English translation).
International Search Report in International Application No. PCT/KR2017/002157, dated Jul. 6, 2017, 3 pages (with partial English translation).
International Search Report in International Application No. PCT/KR2017/002159, dated Jul. 6, 2017, 3 pages (with partial English translation).
International Search Report in International Application No. PCT/KR2017/002162, dated Jul. 6, 2017, 3 pages (with partial English translation).
International Search Report in International Application No. PCT/KR2017/002166, dated Jul. 6, 2017, 3 pages (with partial English translation).
Office Action in Australian Application No. 2017226613, dated Nov. 9, 2018, 3 pages.
Office Action in Australian Application No. 2017227410, dated Nov. 2, 2018, 3 pages.
Office Action in Australian Application No. 2017227411, dated Nov. 6, 2018, 3 pages.
Office Action in U.S. Appl. No. 15/445,018, dated Jul. 10, 2018, 11 pages.
Office Action in U.S. Appl. No. 15/445,325, dated Sep. 25, 2018, 36 pages.
Office Action in U.S. Appl. No. 15/445,456, dated Apr. 11, 2018, 10 pages.
Office Action in U.S. Appl. No. 15/445,493, dated Oct. 15, 2018, 26 pages.
Office Action in U.S. Appl. No. 15/445,494, dated Jul. 12, 2018, 13 pages.
Office Action in U.S. Appl. No. 15/445,508, dated Feb. 22, 2018, 12 pages.
Office Action in U.S. Appl. No. 15/445,289, dated Jan. 28, 2019, 37 pages.
Office Action in U.S. Appl. No. 15/444,742, dated Jan. 28, 2019, 36 pages.
Office Action in U.S. Appl. No. 15/445,379, dated Jan. 28, 2019, 41 pages.
Office Action in U.S. Appl. No. 15/444,761, dated Jan. 31, 2019, 32 pages.
Office Action in U.S. Appl. No. 15/445,326, dated Feb. 8, 2019, 32 pages.
Office Action in U.S. Appl. No. 15/445,214, dated Feb. 8, 2019, 41 pages.

* cited by examiner

VACUUM CLEANER

CROSS-REFERENCE TO RELATED APPLICATIONS

This application claims priority under 35 U.S.C. § 119 to Korean Patent Application No. 10-2016-0024022, filed in Korea on Feb. 29, 2016, and Korean Patent Application No. 10-2016-0036277, filed in Korea on Mar. 25, 2016, and Korean Patent Application No. 10-2016-0184161, filed in Korea on Dec. 30, 2016, the entire contents of which are incorporated by reference herein.

TECHNICAL FIELD

This application is related to technologies related to a vacuum cleaner.

BACKGROUND

Generally, a vacuum cleaner is a device which sucks dust, foreign substances, or the like existing on a surface to be cleaned by using a suction motor provided in an inside portion of a main body thereof, and then filters the dust, the foreign substances, or the like in the inside portion of the main body thereof.

The vacuum cleaner is divided into an up-right type vacuum cleaner in which a suction nozzle is connected to the main body thereof and moves along with the main body thereof and a canister type vacuum cleaner in which the suction nozzle is connected to the main body thereof by an extension pipe, a handle, a hose, or the like.

Korean Patent Laid-Open Publication No. 10-2012-0004100 (publication date: Jan. 12, 2012) which is the related art discloses the canister type vacuum cleaner.

The vacuum cleaner disclosed in the related art includes a suction motor provided in the main body for generating suction force, a dust separating device for separating dust and air sucked by the suction force of the suction motor, and a dust collecting container in which the dust separated from the dust separating device is collected.

The air contained dust is introduced into an introduction pipe provided in the main body through the suction nozzle and a connecting portion by the suction force of the suction motor. The air is sucked into an inside portion of the dust separating device through the introduction pipe. The air sucked into the dust separating device is separated from the dust in the process of flowing through the inside portion of the dust separating device. The dust separated from the dust separating device is collected in the dust collecting container through a dust discharging portion.

Meanwhile, the introduction pipe extends upward from the dust separating device and a lower portion of the dust collecting container toward an inlet portion of the dust separating device in the inside portion of the main body (see FIG. 3 of the related art). With such a structure, in the vacuum cleaner of the related art, the air sucked flows through the introduction pipe, causing a flow loss due to friction. Accordingly, there is a problem that the flowing amount of air introduced into the dust separating device is capable of being reduced, and the suction force of the vacuum cleaner is reduced.

SUMMARY

In general, one innovative aspect of the subject matter described in this specification can be implemented in a vacuum cleaner, comprising: a suction hose that is configured to guide dust; and a cleaner main body that is coupled to the suction hose, that is configured to collect dust from the suction hose based on suction force, and that includes: a main body portion that includes an interior area, a suction motor that is configured to generate suction force, a dust container that is located in the interior area of the main body portion and that includes (i) a storage space to collect dust and (ii) a suction port through which dust is collected from the suction hose into the storage space, and a cover member (i) that is configured to rotate, about an axis that is outside of a plane of the cover member, between a first position and a second position, (ii) that covers, based on the cover member being located at the first position, at least a portion of the dust container, and (iii) that includes a coupling unit that couples the suction hose to the suction port, wherein, based on the cover member being located at the first position, the coupling unit aligns with the suction port.

The foregoing and other implementations can each optionally include one or more of the following features, alone or in combination. In particular, one implementation includes all the following features in combination. The coupling unit includes: an inlet portion through which dust is introduced from the suction hose, and an outlet portion from which dust is discharged into the storage space of the dust container, and wherein, based on the cover member being located at the first position, the outlet portion of the coupling unit is coupled to the suction port. The vacuum cleaner further includes: a sealing member (i) that is configured to couple the outlet portion of the coupling unit to the suction port and (ii) that is configured to block dust from being scattered outside of the coupling unit or the suction port. Based on the cover member being located at the first position, the coupling unit aligns with the suction hose. The suction hose includes: a fitting portion that is located at a first end of the suction hose, and wherein at least a portion of the fitting portion is configured to insert into the coupling unit. The coupling unit includes: a stepped portion on an inside surface of the coupling unit, the stepped portion being configured to (i) hold at least the portion of the fitting portion and (ii) block at least the portion of the fitting portion from being inserted beyond the stepped portion. The dust container includes: a side surface where, in a state in which the cover member covers at least the portion of the dust container, a first portion of the side surface is exposed to an exterior area of the vacuum cleaner, and wherein an interior area of the dust container is viewable from the exterior area of the vacuum cleaner through the first portion of the side surface. The vacuum cleaner further includes: a connecting member that couples the cover member to the main body portion and that is configured to rotate about the axis with the cover member. The cover member includes: a grip portion that is configured to be gripped by a user to move the cover member between the first position and the second position. The main body portion includes: a seat portion that accommodates the dust container.

In general, another innovative aspect of the subject matter described in this specification can be implemented in a vacuum cleaner comprising: a suction hose that is configured to guide dust; and a cleaner main body that is coupled to the suction hose and that includes: a suction motor that is configured to generate suction force, a dust container that includes a storage space to collect dust, a suction port that couples the suction hose to the dust container and through which dust is collected from the suction hose into the dust container, and a cover member that is coupled to the dust container and that includes: a coupling unit that couples the suction hose to the dust container and that is configured to guide, in a horizontal direction relative to a floor, dust from the suction hose into the storage space of the dust container.

In general, another innovative aspect of the subject matter described in this specification can be implemented in a vacuum cleaner comprising: a suction hose that is configured to guide dust; and a cleaner main body that is coupled to the suction hose and that includes: a suction motor that is configured to generate suction force, a dust container that includes: a suction port through which dust is collected from the suction hose into the dust container and that is located on a top surface of the dust container relative to ground, and a cover member that is coupled to the dust container and that includes: a coupling unit including a first end and a second end, the first end being coupled to the suction hose and the second end being coupled to the suction port.

In general, another innovative aspect of the subject matter described in this specification can be implemented in a vacuum cleaner comprising: a suction hose that is configured to guide dust; a cleaner main body that is coupled to the suction hose and that includes a suction motor that is configured to generate suction force; a dust container that is located adjacent to the cleaner main body and that includes (i) a side surface, a first portion of the side surface being exposed to an exterior area of the vacuum cleaner, (ii) a storage space to collect dust, and (iii) an opening to the storage space; a cover member (i) that is configured to rotate, about an axis that is outside of a plane of the cover member, between a first position and a second position and (ii) that covers, based on the cover member being located at the first position, at least a portion of the dust container; a suction port (i) that is coupled to the opening of the dust container, (ii) that is covered by the cover member based on the cover member being located at the first position, and (iii) that includes a passage through which dust is collected from the suction hose into the storage space of the dust container; and a coupling unit (i) that couples the suction hose to the suction port and (ii) that, based on the cover member being located at the first position, aligns with the suction port such that dust received from the suction hose moves into the passage of the suction port through the coupling unit.

The foregoing and other implementations can each optionally include one or more of the following features, alone or in combination. In particular, one implementation includes all the following features in combination. The vacuum cleaner further includes: a first sealing portion that is coupled to a first end of the coupling unit; and a second sealing portion that has a shape corresponding to a shape of the first sealing portion and that is coupled to a first end of the suction port, wherein, based on the cover member being located at the first position, the first sealing portion is coupled to the second sealing portion. The vacuum cleaner further includes: a first sealing portion that is coupled to a first end of the coupling unit and that extends at a first angle relative to ground; and a second sealing portion that is coupled to a first end of the suction port and that extends at the first angle relative to ground, wherein, based on the cover member being located at the first position, the first sealing portion is coupled to the second sealing portion. The first sealing portion and the second sealing portion are inclined toward the suction port downwardly relative to ground. The first sealing portion and the second sealing portion include an elastic material. The coupling unit, a portion of the suction hose that is coupled to the coupling unit, and the suction port align with each other. The cover member is configured to: enclose at least the portion of the dust container, and block dust from being scattered outside of the dust container. The cleaner main body includes: a seat portion that protrudes from a surface of the cleaner main body to accommodate the dust container, and wherein, in a state in which the cover member covers at least the portion of the dust container, a top surface of the dust container is enclosed by the cover member, a bottom surface of the dust container is enclosed by the seat portion, and a side surface of the dust container is exposed to the exterior area of the vacuum cleaner.

The subject matter described in this specification can be implemented in particular examples so as to realize one or more of the following advantages. The present invention is capable of minimizing the air flow loss by reducing resistance acting on the flowing air since the coupling unit is aligned with the air introducing direction at the suction port of the dust container side by side. As a result, suction efficiency of the vacuum cleaner is capable of being improved due to the reduction of the air flow loss.

In addition, since the dust container is exposed to the outside by the cover member shielding only a portion of the dust container, a user is capable of easily confirming the amount of dust collected in the dust container.

In addition, since the first sealing portion forming an end of the coupling unit formed on the cover member and the second sealing portion forming an end of the suction port formed in the dust container are formed to have corresponding inclined surfaces to each other, the first sealing portion and the second sealing portion have an airtight structure which the first sealing portion and the second sealing portion is not interfered with each other and are in close contact with each other when the cover member is rotated.

In particular, the first sealing portion and the second sealing portion are made of an elastic material and are capable of being pressed and fixed to each other. In a state where the cover member is closed, since the first sealing portion and the second sealing portion are capable of being pressed and be in close contact with each other, the air which is introduced into the suction port through the coupling unit is not leaked, thereby being capable of improving suction performance of the vacuum cleaner.

In addition, since the sealing member is provided between the coupling unit and the suction port of the dust container, the airtight between the coupling unit and the dust container is capable of being ensured.

In addition, since the distance between the suction port of the end dust container and the suction hose is formed to be relatively short, it is advantageous for securing a space of the inside portion of the cleaner main body.

In addition, since the suction hose, the coupling unit, and the suction port are capable of being aligned on the same extension line with each other, the flow resistance is capable of being minimized in flow of the air discharged from the suction hose and flowing the suction port.

In addition, since the end of the suction hose is inserted into the inside of the coupling unit and extends to a position adjacent to the suction port, the air discharged from the suction hose is capable of being effectively introduced into the suction port.

In the vacuum cleaner of the present invention, since the center of gravity of the battery is located forward and rotates forward in a state where the battery is separated from the main body portion, the battery is capable of being easily coupled from the cleaner main body.

In addition, since the cleaner main body is supported at two points by a pair of moving wheels, the cleaner main body is capable of easily moving over obstacles such as thick carpets and a blanket.

In addition, since the mounting position of the battery is located on the lower side of the cleaner main body, the center of gravity of the cleaner main body moves downward, thereby being capable of improving the running stability of the cleaner main body.

In addition, since the support portion is provided at the rear side of the main body portion, it is possible to prevent the main body portion from being turned over rearward.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

Embodiments will be described in detail with reference to the following drawings in which like reference numerals refer to like elements, and wherein.

DETAILED DESCRIPTION

Figure 1:
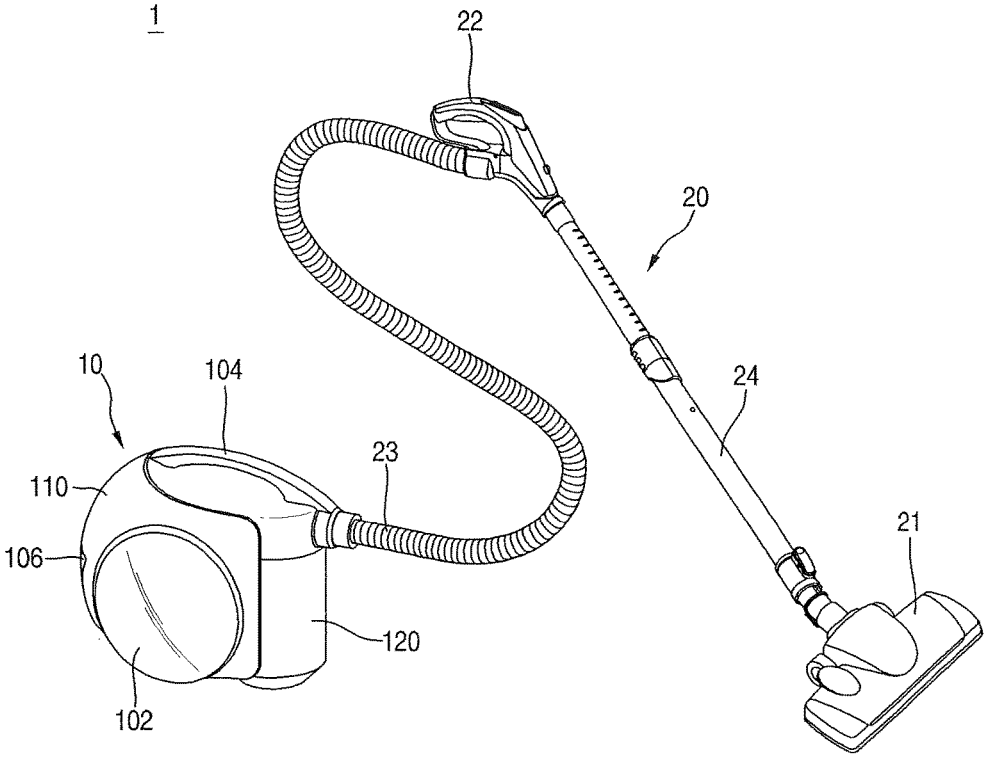
FIG. 1 is a perspective view of a vacuum cleaner according to an embodiment of the present invention.

Hereinafter, some embodiments of the present invention will be described in detail with reference to exemplary drawings. In adding reference numerals to the components of the respective drawings, it should be noted that the same components are denoted by the same reference symbols as possible even if they are illustrated in different drawings.

In addition, in describing the components of the embodiment of the present invention, terms such as first, second, A, B, (a), and (b) may be used. These terms are intended to distinguish the components from other components, and the terms do not limit the nature, the order or the sequence of the components. In a case where a component is described as being "attached", "coupled", or "connected" to another component, although the component may be directly attached or connected to the other component, it is to be understood that another component may be "attached", "coupled", or "connected" between components, respectively.

FIG. 1 is a perspective view illustrating a vacuum cleaner according to an embodiment of the present invention.

Referring to FIG. 1, a vacuum cleaner 1 according to an embodiment of the present invention includes a cleaner main body 10 and a suction device 20.

The cleaner main body 10 has a suction motor for generating a suction force. When the suction motor is driven to generate the suction force, the suction device 20 is capable of guiding dust-containing air to the cleaner main body 10.

The suction device 20 may include a suction portion 21 for sucking dust on a surface to be cleaned, for example, a floor surface and connecting portions 22, 23, and 24 for connecting the suction portion 21 to the cleaner main body 10. The connecting portions 22, 23 and 24 may include an extension pipe 24 connected to the suction portion 21, a handle 22 connected to the extension pipe 24, and a suction hose 23 connecting a handle 22 to the cleaner main body 10.

The cleaner main body 10 includes a main body portion 110 which forms an overall outer appearance.

The cleaner main body 10 may further include a moving wheel 102 rotatably coupled to the main body portion 110. A pair of moving wheels 102 may be provided and may be coupled to both sides of the main body portion 110, respectively.

The main body portion 110 may include a grip portion 104 for gripping by a user. The user is capable of grasping the grip portion 104 when lifting or inclining the main body portion 110.

The cleaner main body 10 may further include a battery 106 for supplying power.

The battery 106 may be detachably coupled to the main body portion 110. In a case where the battery 106 is coupled to the main body portion 110, the battery 106 is capable of being integrated with the main body portion 110. Accordingly, the battery 106 moves along with the main body portion 110.

The battery 106 may supply power necessary for all the operations of the vacuum cleaner 1. The battery 106 may be a secondary battery which is capable of being charged and discharged. A power cord (not illustrated) for supplying commercial power may be separately connected to the battery 106.

The cleaner main body 10 further includes a dust container 120 in which the dust sucked through the suction device 20 is stored. Although the dust container 120 may have a cylindrical shape as illustrated in the drawings, the shape of the dust container 120 is not limited thereto.

The dust container 120 may have a suction port 124 through which dust is sucked. The suction port 124 may be disposed on an upper surface portion of the dust container 120 as illustrated in the drawings. Accordingly, the air introduced into the suction port 124 is guided downward and moves to a storage space.

The dust container 120 may be detachably mounted on the main body portion 110. A storage space for collecting dust introduced into the suction port 124 may be formed in an inside portion of the dust container 120.

The dust container 120 may be provided in the front side of the main body portion 110 and a side surface portion of the dust container 120 may be at least partially made of a transparent material so that the user confirms the dust collected in the storage space.

The vacuum cleaner 1 may include a dust separating portion (not illustrated) for separating dust and air sucked in the suction device 20 from each other. The dust separating portion may be manufactured as a separate article from the dust container 120 or may form one module with the dust container 120. For example, the dust separating portion may be provided in the inside portion of the dust container 120 and the dust separated from the dust separating portion may be collected in a lower side of the dust container 120.

Figure 2:
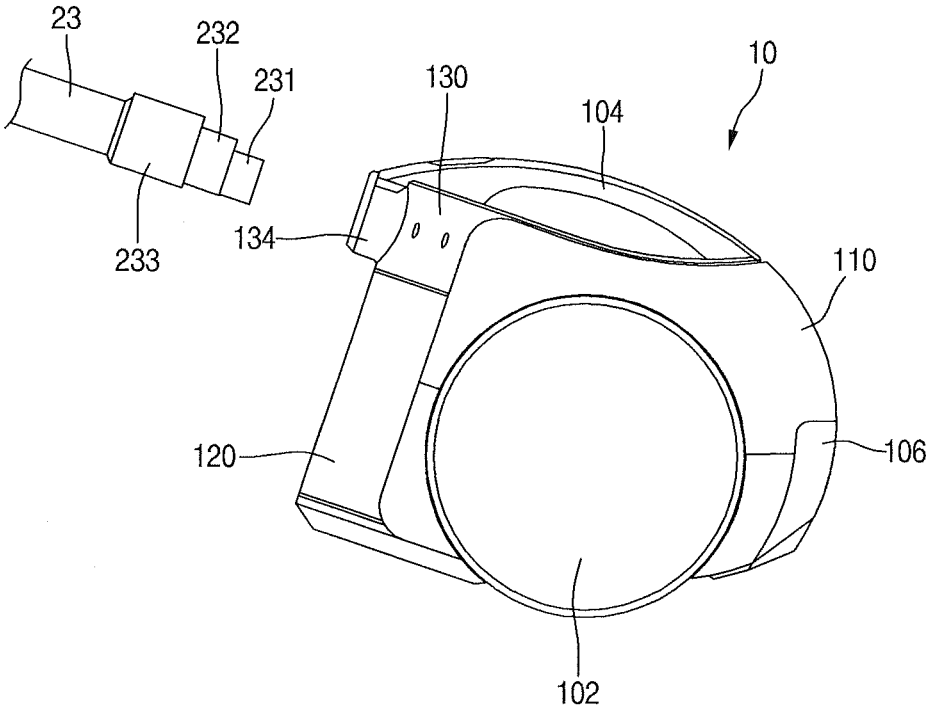
FIG. 2 is a view illustrating a state where a cleaner main body and a suction device of FIG. 1 are separated from each other.
Figure 3:
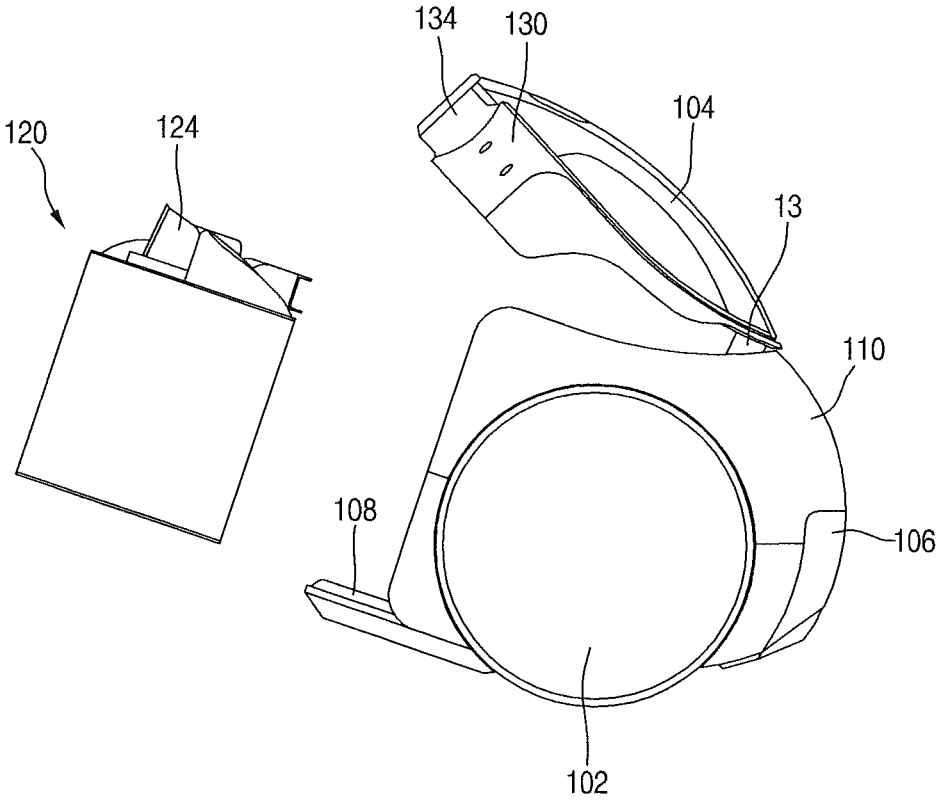
FIG. 3 is a view illustrating a state where a dust container of FIG. 2 is separated from a main body portion.

FIG. 2 is a view illustrating a state where the cleaner main body and the suction device of FIG. 1 are separated from each other and FIG. 3 is a view illustrating a state where the dust container of FIG. 2 is separated from the main body portion.

Referring to FIG. 2 and FIG. 3, the cleaner main body 10 may include a coupling unit 134 connected to the suction device 20. The coupling unit 134 is directly connected to the suction hose 23 so that dust-containing air is capable of being introduced therein. In other words, a side of the coupling unit 134 is coupled to the suction hose 23 and the other side thereof is coupled to the suction port 124. Accordingly, the coupling unit 134 connects the suction hose 23 and the suction port 124 with each other.

The coupling unit 134 may communicate with the dust container 120. Accordingly, the air introduced into the suction hose 23 is capable of being introduced into the dust container 120 through the coupling unit 134.

A suction port 124 through which the dust is introduced may be provided on a side of the dust container 120. The suction port 124 may be provided on the upper portion (or the upper surface portion) of the dust container 120, as illustrated in the drawings.

In addition, the suction port 124 may be formed to face the front side. Here, the front side refers to a portion where the suction hose 23 is located with respect to the cleaner main body 10.

In addition, as illustrated in the drawings, the coupling unit 134 may be disposed on the upper portion of the dust container 120. Since both the suction port 124 and the coupling unit 134 are disposed on the upper portion of the dust container 120, the length of a flow path of air introduced from the suction hose 23 is capable of being minimized.

The suction hose 23 may include fitting portions 231, 232, and 233 for improving the airtight when being coupled with the coupling unit 134.

The fitting portions 231, 232, and 233 are capable of attaching and detaching the suction hose 23 to and from the coupling unit 134. The fitting portions 231, 232, and 233 may be formed to be multi-stepped, as illustrated in the drawings.

The fitting portions 231, 232, and 233 may include a first fitting portion 231, a second fitting portion 232, and a third fitting portion 233. The first fitting portion 231 and the second fitting portion 232 are inserted into the inside portion of the coupling unit 134. Therefore, the first fitting portion 231 and the second fitting portion 232 are collectively referred to as insertion portions, which may be referred to as a first insertion portion and a second insertion portion, respectively. The third fitting portion 233 is provided outside the coupling unit 134. The third fitting portion 233 may be in contact with the end of the coupling unit 134 to limit the insertion depth of the insertion portion.

The cleaner main body 10 further includes a cover member 130 movably provided in the main body portion 110.

The cleaner main body 10 may further include the connecting member 13 connecting the cover member 130 and the main body portion 110 with each other. For example, the cover member 130 may be rotatably connected to the main body portion 110 by the connecting member 13.

The cover member 130 may include the coupling unit 134. Accordingly, the coupling unit 134 is capable of moving along with the cover member 130.

The cover member 130 may shield at least one side of the dust container 120. The cover member 130 may shield at least one side of the dust container 120 and may couple with the dust container 120. The cover member 130 is capable of being coupled with the dust container 120 when the cover member 130 is closed and separated from the dust container 120 when the cover member 130 is opened.

For example, the cover member 130 may be coupled to the upper portion of the dust container 120.

The dust container 120 may be separated from the main body portion 110 as illustrated in FIG. 3.

The main body portion 110 may include a seat portion 108 on which the dust container 120 is seated. The seat portion 108 may be disposed on a lower portion of the dust container 120 as illustrated in the drawings. The seat portion 108 may be formed with a coupling portion (not illustrated) for coupling with a lower surface portion of the dust container 120.

Meanwhile, the lower surface portion of the dust container 120 may be referred to as a side of the dust container 120 and the upper surface portion of the dust container 120 may be referred to as the other side of the dust container 120. Since the cover member 130 is coupled to the dust container 120 from the upper side of the dust container 120, the cover member 130 is capable of being seen to be provided on a side opposite to the seat portion 108.

Hereinafter, a state where the cover member 130 is opened and a state where the cover member 130 is closed will be described specifically.

Figure 4:
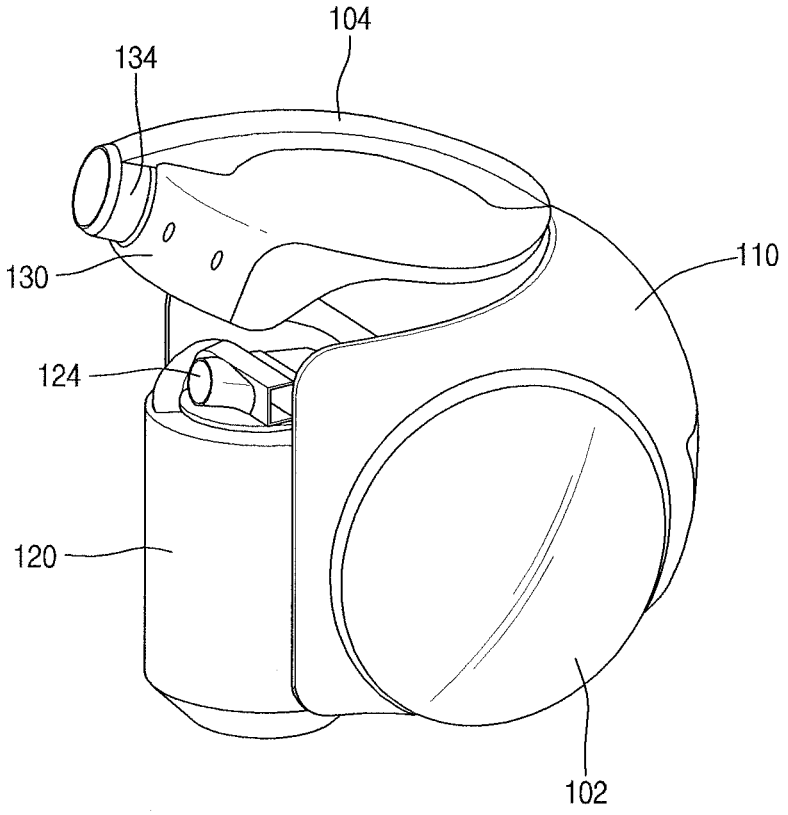
FIG. 4 is a perspective view illustrating the cleaner main body when the cover member is opened.
Figure 5:
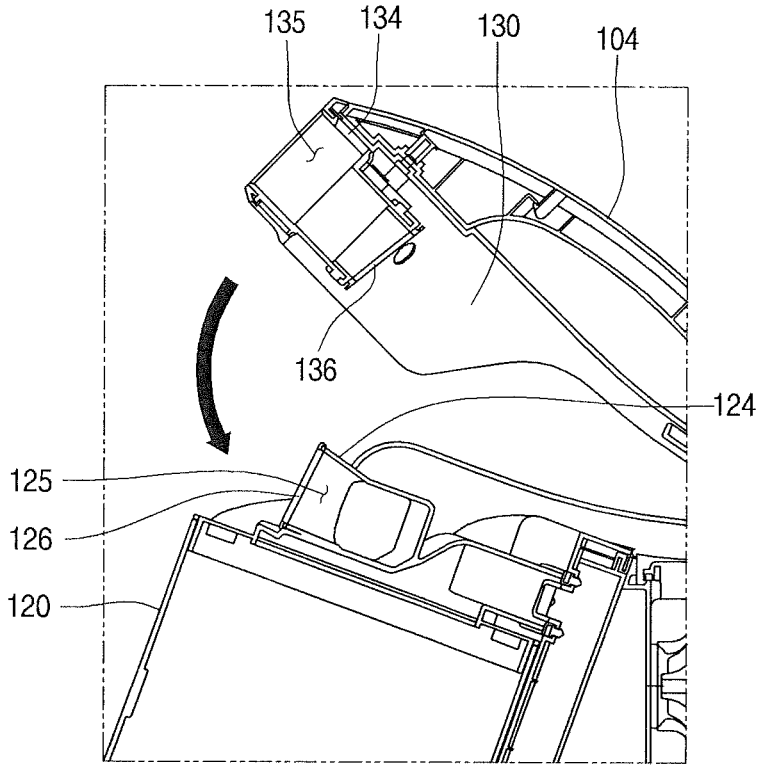
FIG. 5 is a longitudinal sectional view of FIG. 4.
Figure 6:
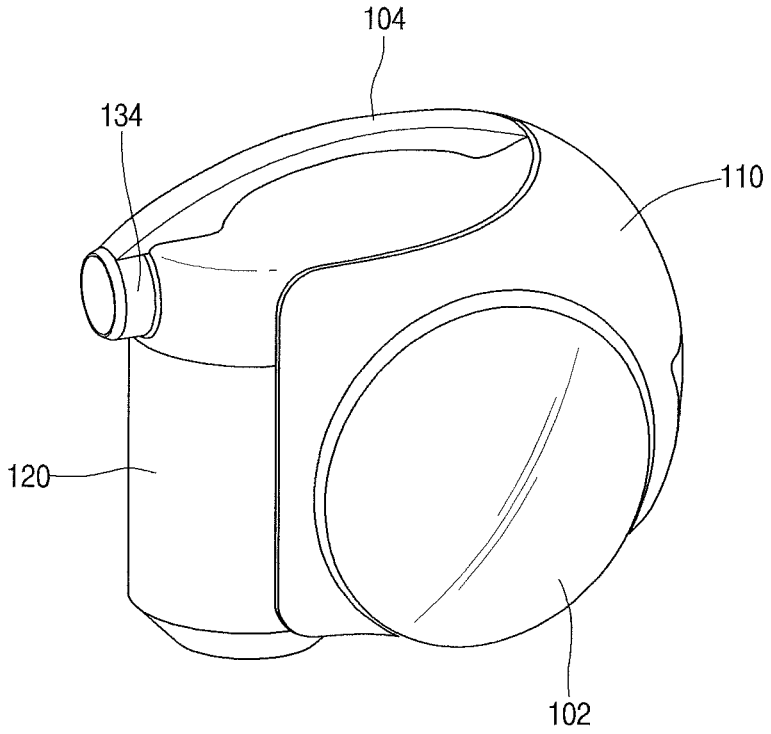
FIG. 6 is a perspective view illustrating the cleaner main body when the cover member is closed.
Figure 7:
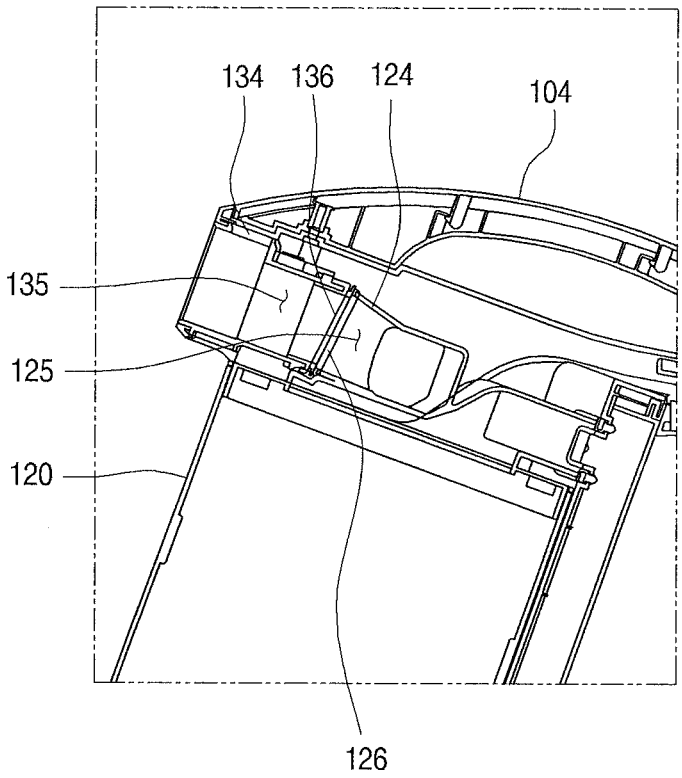
FIG. 7 is a longitudinal sectional view of FIG. 6.

FIG. 4 is a perspective view illustrating the cleaner main body when the cover member is opened, FIG. 5 is a longitudinal sectional view of FIG. 4, FIG. 6 is a perspective view illustrating the cleaner main body when the cover member is closed, and FIG. 7 is a longitudinal sectional view of FIG. 6.

Referring to FIG. 4 to FIG. 7, when the cover member 130 is opened, a user grasps the grip portion 104 and lifts the cover member 130 upward or rotates the cover member 130 rearward. On the other hand, when the cover member 140 is closed, the user is capable of lowering the cover member 130 downward or rotating the cover member 130 forward.

In a case where the cover member 130 is opened, the user is capable of taking out the dust container 120 to the outside of the vacuum cleaner. At this time, the suction port 124 of the dust container 120 is exposed to the outside of the vacuum cleaner.

In a case where the cover member 130 is closed, at least one side of the dust container 120 is shielded by the cover member 130. When a side of the dust container 120 is shielded by the cover member 130, the suction port 124 is also shielded by the cover member 130.

However, since the cover member 130 does not shield a side surface portion of the dust container 120, the side surface portion of the dust container 120 is exposed to the outside. Accordingly, since the side surface portion of the dust container 120 is at least partially made of transparent material, the user is capable of visually confirming the amount of dust collected in the storage space of the inside portion of the dust container 120.

When the suction port 124 is shielded by the cover member 130, the suction port 124 is in contact with an outlet portion of the coupling unit 134. Accordingly, the coupling unit 134 communicates with the suction port 124. At this time, the coupling unit 134 may be aligned with the air introducing direction at the suction port 124 side by side.

A first space portion 135 is formed in the inside of the coupling unit 134 and a second space portion 125 is formed in the inside of the suction port 124. When the cover member 130 is closed, the first space portion 135 and the second space portion 125 are directly connected to each other.

Meanwhile, when the cover member 130 is closed, a rear end of the coupling unit 134 and a front end of the suction port 124 are in close contact with each other to be in an airtight state and the air passing through the coupling unit 134 is not leaked to the outside and all the air is capable of being introduced into the inside portion of the dust container 120.

Hereinafter, this will be described in more detail. For convenience of description, a direction in which the suction hose 23 is connected (left side in FIG. 5) is referred to as a front direction and a direction which is in contact with the dust container 120 (the right side in FIG. 5) is referred to as a rear direction.

An opened rear end of the coupling unit 134 is capable of extending into the inside of the cover member 130 and extending to a position corresponding to an opened front end of the suction port 124 when the cover member 130 is closed.

A first sealing portion 136 may be formed at a rear end of the coupling unit 134 and a second sealing portion 126 may be formed at a front end of the suction port 124. The first sealing portion 136 and the second sealing portion 126 may be formed in corresponding shapes at positions facing each other and may be configured to be in close contact and be coupled with each other when the cover member 130 is closed.

More specifically, the first sealing portion 136 may be formed to be inclined, and may be inclined forward in the downward direction. The second sealing portion 126 may be inclined in the same direction as that of the first sealing portion 136, and may be also inclined forward in the downward direction.

Meanwhile, a direction of the inclined surfaces of the first sealing portion 136 and second sealing portion 126 may be formed to correspond to the rotation direction in which the cover member 130 is opened and closed. A direction of the inclined surfaces of the first sealing portion 136 and the second sealing portion 126 may be formed so as to correspond to a tangent of the rotating radius of the cover member 130.

In other words, the rotation center of the cover member 130 is positioned at the rear end of the cover member 130, and when the cover member 130 rotates, slopes of the first sealing portion 136 and the second sealing portion 126 may be formed to have the same slope as the tangent of the rotation radius of the cover member 130 in order for the first sealing portion 136 and the second sealing portions 126 which are in positions spaced apart from the rotation center of the cover member 130 when rotating the cover member 130 to be close contact with each other while naturally sliding to each other.

The cover member 130 is capable of being effectively airtight without the coupling unit 134 and the suction port 124 being interfered with each other when the cover member 130 is rotatably operated to be closed by the slope structure of the first sealing portion 136 and the second sealing portion 126.

The inside portion of the coupling unit 134 and the inside portion of the suction port 124 may form a first space portion 135 and a second space portion 125, respectively. At this time, the rear end of the first space portion 135 and the front end of the space portion 125 may have a size corresponding to each other. The first sealing portion 136 and the second sealing portion 126 may be formed to have the same inclined surface. Accordingly, the first space portion 135 and the second space portion 125 are capable of having a completely communicated structure in a state where the cover member 130 is closed.

The first sealing portion 136 and the second sealing portion 126 may be formed together when the coupling unit 134 and the suction port 124 are shaped. In other words, the first sealing portion 136 and second sealing portion 126 may be made of a plastic material, respectively and may be integrally shaped with the coupling unit 134 and the suction port 124.

If necessary, a sealing member for airtight may be mounted on the first sealing portion 136 and the second sealing portion 126. The sealing member may be formed around the opened end portions of the first sealing portion 136 and the second sealing portion 126 and may be mounted on at least one of the first sealing portion 136 and the second sealing portion 126. The sealing member may be made of a material having elasticity such as rubber, silicone, and sponge. Therefore, when the cover member 130 is closed, the complete airtight is capable of being provided between the first sealing portion 136 and the second sealing portion 126 by the compression of the sealing member. In addition, the elasticity is provided when the cover member 130 is closed or opened, thereby the impact is alleviated when the cover member 130 is closed, and the initial rotation is performed easier when the cover member 130 is opened.

Of course, the first sealing portion 136 and the second sealing portion 126 may be made of a separate material having elasticity, if necessary. In other words, the first sealing portion 136 and the second sealing portion 126 are separately made of a material having elasticity such as rubber, silicone, and sponge, and then fixedly mounted on the rear end of the coupling unit 134 and the front end of the suction port 24.

At this time, the first sealing portion 136 and the second sealing portion 126 may be mounted to be inclined or the surfaces thereof which are in contact with each other may be formed to be inclined. The first sealing portion 136 and the second sealing portion 126 having elasticity may be formed to have a predetermined thickness in order to be compressed with each other in a state where the cover member 130 is closed. The first sealing portion 136 and the second sealing portion 126 are capable of being completely airtight by the first sealing portion 136 and the second sealing portion 126 made of an elastic material and the impact upon opening and closing of the cover member 130 is capable of being alleviated and opened easily.

In a case where the first sealing portion 136 and the second sealing portion 126 are made of an elastic material, when the cover member 130 is closed, the first sealing portion 136 and the second sealing portion 126 are in close contact with each other while being pressed against each other. Accordingly, the first sealing portion 136 and the second sealing portion 126 may be in contact with each other in a compressed state in a state where the cover member 130 is closed and the airtight performance is capable of being further improved between the coupling unit 134 and the suction port 124.

Hereinafter, a case where the suction hose 23 is mounted on the coupling unit 134 will be described.

Figure 8:
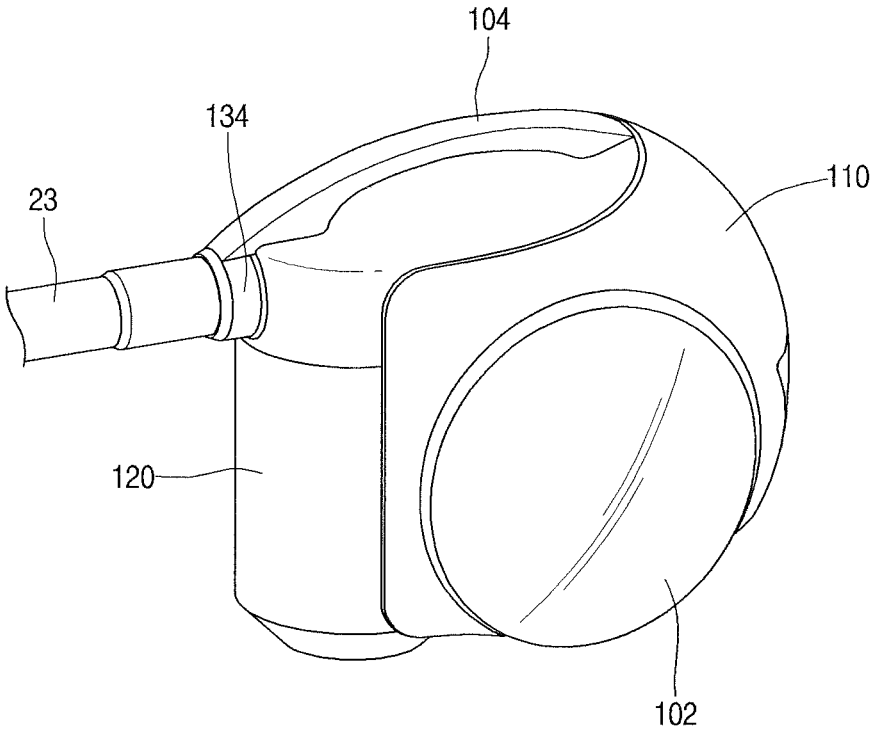
FIG. 8 is a perspective view illustrating a state where the suction device is coupled to the cleaner main body.
Figure 9:
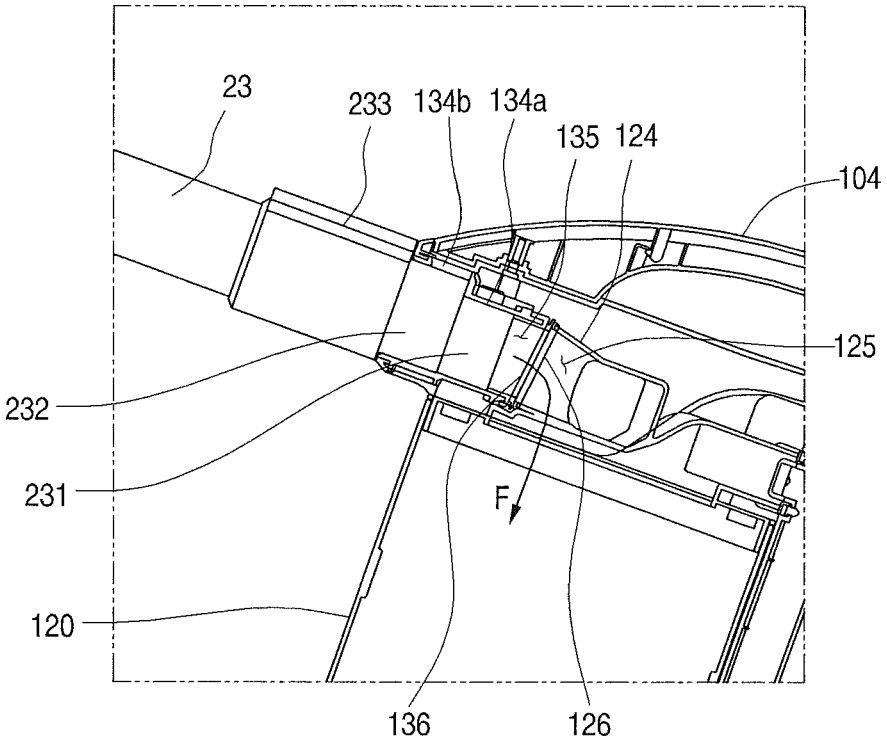
FIG. 9 is a longitudinal sectional view of FIG. 8.

FIG. 8 is a perspective view illustrating a state where the suction device is coupled to the cleaner main body, and FIG. 9 is a longitudinal sectional view of FIG. 8.

Referring to FIG. 8 and FIG. 9, the suction hose 23 is connected to the coupling unit 134. A front end (left side in FIG. 9) to which the suction hose 23 is connected in the coupling unit 134 is capable of being defined as an inlet portion and a rear end (right side in FIG. 9) in which air is discharged is capable of being defined as an outlet portion. The outlet portion of the coupling unit 134 faces the suction port 124 each other and is capable of being in contact with each other.

At this time, the outlet portion of the coupling unit 134 is capable of communicating with the suction port 124. The first sealing portion 136 of the coupling unit 134 and the second sealing portion 126 of the suction port 124 are in contact with each other and the coupling unit 134 and the suction port may completely communicate with each other.

Specifically, the air discharged from the suction hose 23 may introduces into the inside portion of the dust container 120 through the first space part 135 and the second space part 125 in this order. The flow path from the first space portion 135 and the second space portion 125 to the dust container 12 may be defined as a suction flow path F.

As illustrated in the drawings, the suction flow path F is introduced from the coupling unit 134 into the suction port 124 and then guided downward to the storage space.

The suction flow path F may be divided into a first flow path defined in the first space portion 135 and a second flow path defined in the second space portion 125.

The first space portion 135 and the second space portion 125 are connected with each other when the coupling unit 134 and the suction port 124 are connected with each other, thereby forming a flow path which is connected the first flow path and the second flow path with each other.

In this state, the flow path is linearly connected by the close contact of the first sealing portion 136 and the second sealing portion 126, and the suction hose 23 is also linearly connected to the coupling unit 134 so that the air introduced through the suction hose 23 is capable of linearly flowing with the shortest distance toward the dust container 20.

As described above, the airtight between the suction hose 23 and the coupling unit 134 is capable of being maintained by the fitting portions 231, 232, and 233.

The first fitting portion 231, the second fitting portion 232, and the third fitting portion 233 may have a diameter which is gradually increased in this order, respectively. Accordingly, a step may be formed between the first fitting portion 231 and the second fitting portion 232 and a step may be formed between the second fitting portion 232 and the third fitting portion 233.

The first fitting portion 231 and the second fitting portion 232 are inserted into an inside portion of the first space portion 135.

The coupling unit 134 may have stepped portions 134*a* and 134*b*. At least a portion of the fitting portions 231, 232, and 233 may be caught by the stepped portions 134*a* and 134*b* to limit the insertion range. In addition, the stepped portions 134*a* and 134*b* are in surface contact with the fitting portions 231, 232 and 233 to improve airtight between the fitting portions 231, 232 and 233 and the first space portion 135.

The stepped portions 134*a* and 134*b* may include a first stepped portion 134*a* and a second stepped portion 134*b*.

The first stepped portion 134*a* may be provided in the first space portion 135. The end of the second fitting portion 232 may be in contact with the first stepped portion 134*a*.

The second stepped portion 134*b* may be provided on an outside of the coupling unit 134. The end portion of the third fitting portion 233 may be in contact with the second stepped portion 134*b*.

The suction hose 23 may be aligned in line with the air flow direction in the first space portion 135. Accordingly, the resistance of the air which is discharged from the suction hose 23 and flows to the first space portion 135 is reduced.

As described above, in the vacuum cleaner 1 of the present invention, since the suction hose 23, the coupling unit 134, and the suction port 124 are arranged in a line, the resistance of the air discharged from the suction hose 23 is minimized. The stepped portion 134*a* of the suction hose 23 is capable of extending to a position adjacent to the suction port 124 in a state of being inserted into the inside portion of the coupling unit 134. Accordingly, the suction hose 23 may be in a state of being aligned with the suction port 124 in the inside portion of the coupling unit 134. Therefore, the air discharged from the suction hose 23 is capable of flowing directly toward the suction port 124.

In addition, the first sealing portion 136 and the second sealing portion 126 formed on the coupling unit 134 and the suction port 124 are capable of being in close contact with each other in a state of being inclined state to effectively maintain the airtight state. Accordingly, the leakage of the liquid is capable of being prevented.

Accordingly, the air flow loss in the inside portion of the cleaner main body 10 is capable of being minimized, and as a result, the suction efficiency of the vacuum cleaner 1 is capable of being improved.

Various other embodiments of the present invention will be possible in addition to the embodiment described above.

Configurations of another embodiment of the present invention will be the same as those of the embodiment described above except for some configurations, and the same names are used for the same configurations, and a detailed description thereof will be omitted.

Figure 10:
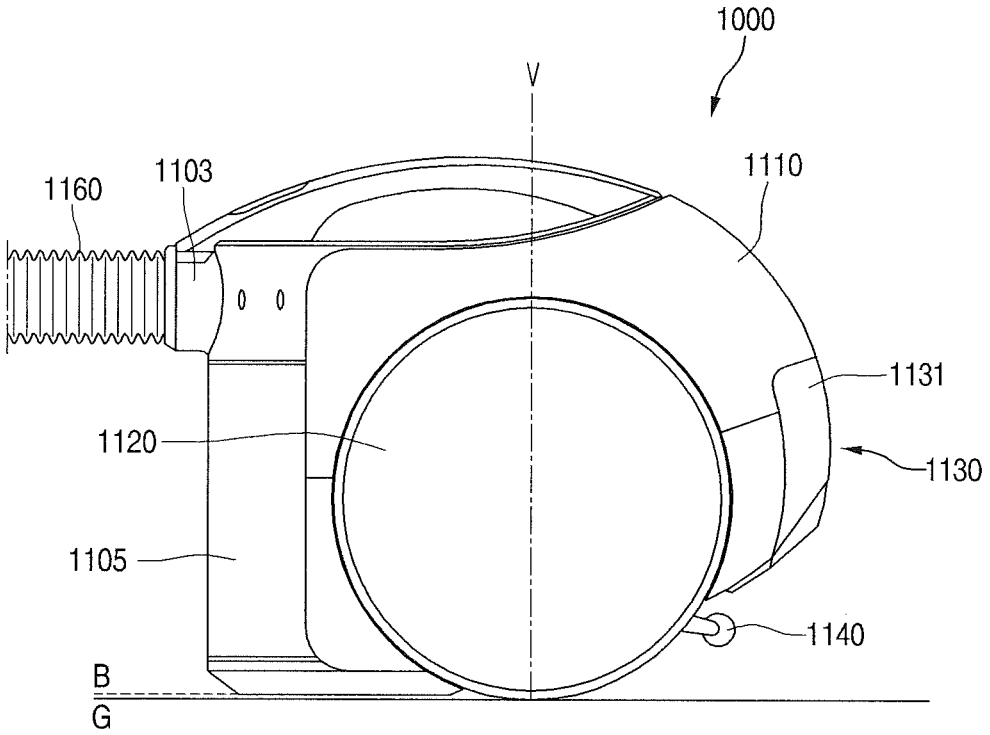
FIG. 10 is a view illustrating a state where a main body portion of a cleaner main body is inclined forward according to another embodiment of the present invention.
Figure 11:
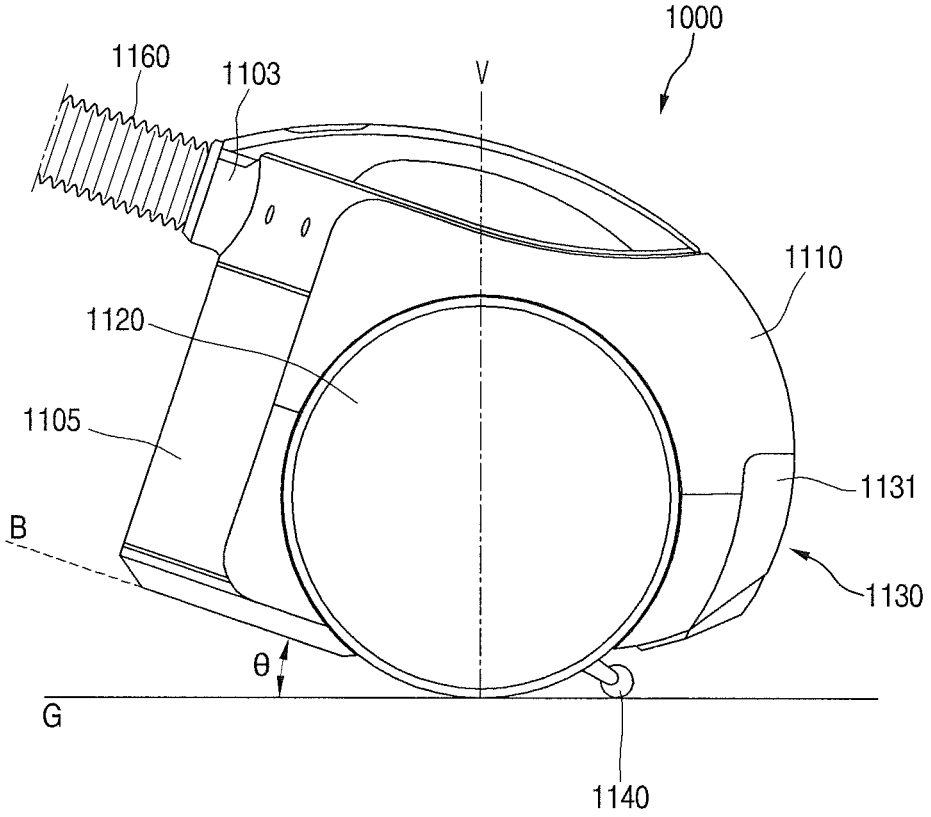
FIG. 11 is a view illustrating a state where the main body portion is inclined rearward.
Figure 12:
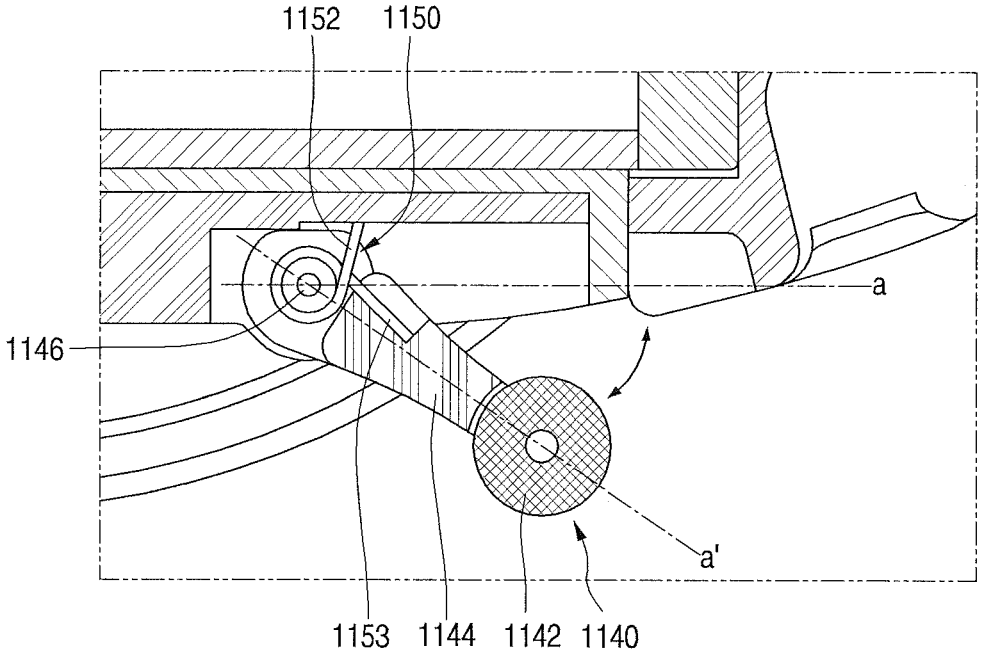
FIG. 12 is a view illustrating a configuration of a support portion according to another embodiment of the present invention.

FIG. 10 is a view illustrating a state where a main body portion of a cleaner main body is inclined forward according to another embodiment of the present invention. FIG. 11 is a view illustrating a state where the main body portion is inclined rearward. FIG. 12 is a view illustrating a configuration of a support portion according to another embodiment of the present invention.

Referring to FIG. 10 to FIG. 12, a cleaner main body 1000 includes a main body portion 1110, a moving wheel 1120, and a battery 1130.

The main body portion 1110 may include a dust container 1105 for storing dust sucked through a suction device 1160. A pair of moving wheels 1120 may be coupled to both sides of the main body portion 1110, respectively. The battery 1130 may be detachably coupled to the main body portion 1110.

A portion where the coupling unit 1103 is disposed may be defined as a front side and a portion where the battery 1130 is disposed may be defined as a rear side, with respect to a vertical line V passing through the rotation center of the moving wheel 1120 in the cleaner main body 1000. In addition, a case where the main body portion 1110 rotates in the front side means that the main body portion 1110 rotates in the counterclockwise direction in the drawing (see FIG. 10) and a case where the main body portion 1110 rotates in the rear side means that the main body portion 1110 rotates in the clockwise direction in the drawing (see FIG. 11).

The cleaner main body 1000 may further include a driving portion for driving the moving wheels 1120. The cleaner main body 1000 may control the driving of the mobile wheel 1120 by the control portion according to sensing information of a sensing portion which senses the movement of the cleaner main body 1000.

In a case where the sensing portion is in an OFF state, the moving wheel 1120 may not be driven. In this case, the main body portion 1110 is inclined according to a position of the center of gravity. For example, when the center of gravity of the main body portion 1110 is positioned in the front side of the vertical line V passing the rotation center of the moving wheel 1120, the main body portion 1110 is inclined forward as illustrated in FIG. 10, and when the center of gravity of the main body portion 1110 is positioned at the rear side the vertical line V, the main body portion 1110 is inclined rearward as illustrated in FIG. 11.

When the sensing portion is turned on, the control portion may control the driving of the moving wheel 1120 such that the center of gravity of the main body portion 1110 is positioned on the vertical line V passing the rotation center of the moving wheel 1120. In this case, a lower surface B of the main body portion 1110 may be spaced apart from a bottom surface G as illustrated in FIG. 11.

The cleaner main body 1000 may further include a rear wheel unit 1140. The rear wheel unit 1140 is disposed on the rear side of the lower surface of the main body portion 1110 and may function to restrict an angle at which the main body portion 1110 inclined rearward.

The rear wheel unit 1140 may further include an extending portion 1144. An auxiliary wheel 1142 may be rotatably connected to a side of the extending portion 1144. The other side of the extending portion 1144 may be rotatably connected to the main body portion 1110 by the rotation shaft 1146. The extending portion 1144 is capable of rotating upward or downward within the range of a-a'.

The rear wheel unit 1140 may further include an elastic member 1150. For example, the elastic member 1150 may be a torsion spring. An end 1152 of the elastic member 1150 is capable of being supported by the main body portion 1110 and the other end 1153 of the elastic member 1150 is capable of being supported by the extending portion 1144. The elastic member 1150 may apply an elastic force such that the extending portion 1144 rotates in the clockwise direction in the drawing.

The front side portion of the lower surface B of the main body portion 1110 is capable of being in contact with the bottom surface G when the main body portion 1110 is inclined forward as much as possible. Accordingly, the maximum rotation angle of the main body portion 1110 is capable of being limited in the forward direction.

Conversely, when the main body portion 1110 is inclined rearward, the rear wheel unit 1140 is capable of being in contact with the bottom surface G. Accordingly, the maximum rotation angle of the main body portion 1110 to the rear side is capable of being limited. Accordingly, the main body portion 1110 is capable of being prevented from being turned over forward or rearward.

The lower surface B of the main body portion 1110 may form a predetermined angle □ with the bottom surface G when the main body portion 1110 rotates rearward as much as possible. At this time, an angle □ between the lower surface B of the main body portion 1110 and the bottom surface G may be approximately 17° to 20°.

The battery 1130 may include a cover 1131. The cover 1131 may be exposed to the outside in a state where the battery 1130 is mounted on the main body portion 1110. Accordingly, the cover 1131 is capable of forming at least a portion of an outer appearance of the main body portion 1110. In addition, the user is capable of separating the battery 1130 from the main body portion 1110 or couple the battery 1130 to the main body portion 1110 without disassembling the main body portion 1110.

Hereinafter, the process of attachment and detachment of the battery 1130 to and from the main body portion 1110 will be described in detail. However, the following description is limited only that in a case where the battery 1130 is removed from the main body portion 1110, the center of gravity of the main body portion 1110 is positioned forward and in a case where the battery 1130 is coupled to the main body portion 1110, the center of gravity of the main body portion 1110 is located at the rear side.

Figure 13:
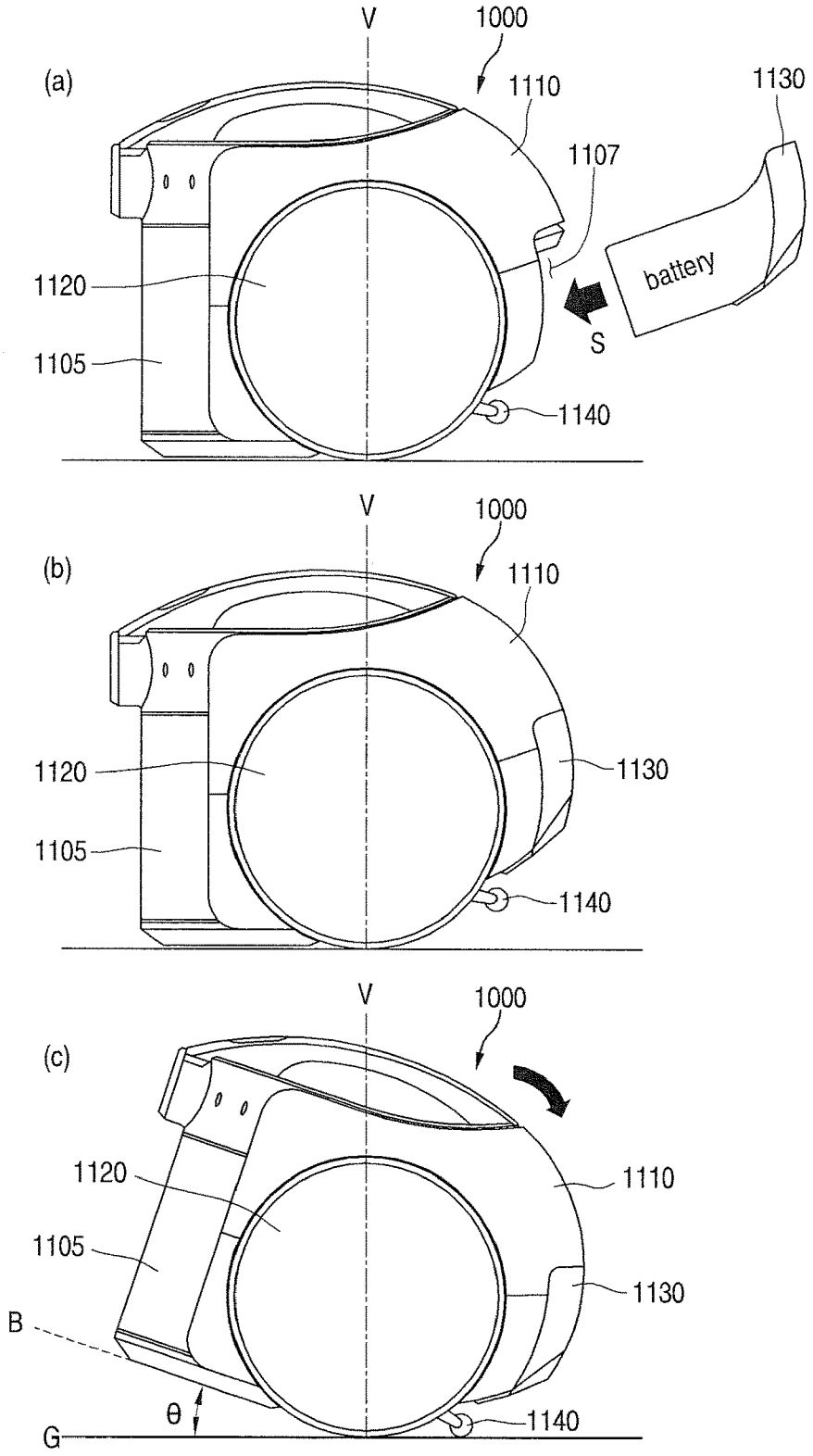
FIG. 13 is a view sequentially illustrating a state where the battery is coupled to the cleaner main body.

FIG. 13 is a view sequentially illustrating a state where the battery is coupled to the cleaner main body.

FIG. 13A is a view illustrating a state where the battery 1130 is separated from the main body portion 1110, and FIG. 13B is a view illustrating a state where the battery 1130 is coupled to the main body portion 1110 and FIG. 13C is a view illustrating a state where the main body portion 1110 is inclined rearward.

The main body portion 1110 is formed with a battery coupling portion 1107 to which the battery 1130 is coupled. The battery coupling portion 1107 may be formed by a portion of the main body portion 1110 being depressed.

The battery coupling portion 1107 is formed on the lower side of the main body portion 1110 so that the battery 1130 is coupled to the lower side of the main body portion 1110. For example, the center of gravity of the battery 1130 may be positioned at the lower side of the rotation center of the moving wheel 1120 in a state where the battery 1130 is mounted on the main body portion 1110.

Therefore, when the battery 1130 is coupled to the main body portion 1110, since the center of gravity of the main body portion 1110 is capable of being moved downward, running stability of the cleaner main body 1000 is capable of being improved.

Although the running stability is improved when the battery 1130 is coupled to the lower side of the main body portion 1110, since the battery 1130 must be coupled to the lower side of the main body portion 1110, the user may result in discomfort for coupling the battery 1130.

However, the center of gravity of the main body portion 1110 may be positioned in the front side of the vertical line passing through the center of the moving wheel 1120 in a state where the battery 1130 is separated from the main body portion 1110. Accordingly, when the battery 1130 is separated from the main body portion 1110, the main body portion 1110 is capable of being inclined forward about the mobile wheel 1120.

As the main body portion 1110 is inclined forward, the front portion of the lower surface of the main body portion 1110 is in contact with the bottom surface, and at this time, the battery coupling portion 1107 is oriented obliquely upward. Accordingly, the user is capable of easily assembling the battery 1130.

The battery 1130 may be coupled to the body portion 1110 in an oblique direction by a coupling guide portion provided in the battery coupling portion 1107. Specifically, an inserting direction S of the battery 1130 may be an acute angle with the vertical line V and the bottom surface, respectively. Therefore, in a case where the front portion of the lower surface of the main body portion 1110 is in contact with the bottom surface, the insertion direction S of the battery 1130 forms an acute angle with the bottom surface.

When the battery 1130 is coupled to the main body portion 1110, the center of gravity of the main body portion 1110 is capable of moving rearward. In other words, the center of gravity of the main body portion 1110 may be positioned behind the vertical line passing through the center of the moving wheel 1120 in a state where the battery 1130 is coupled to the main body portion 1110.

In other words, when the battery 1130 is coupled to the main body portion 1110, the main body portion 1110 is capable of being inclined rearward about the movement wheel 1120. At this time, the rear wheel unit 1140 is selectively in contact with the bottom surface. At this time, the lower surface B of the main body portion 1110 forms a predetermined angle □ with the bottom surface G.

Figure 14:
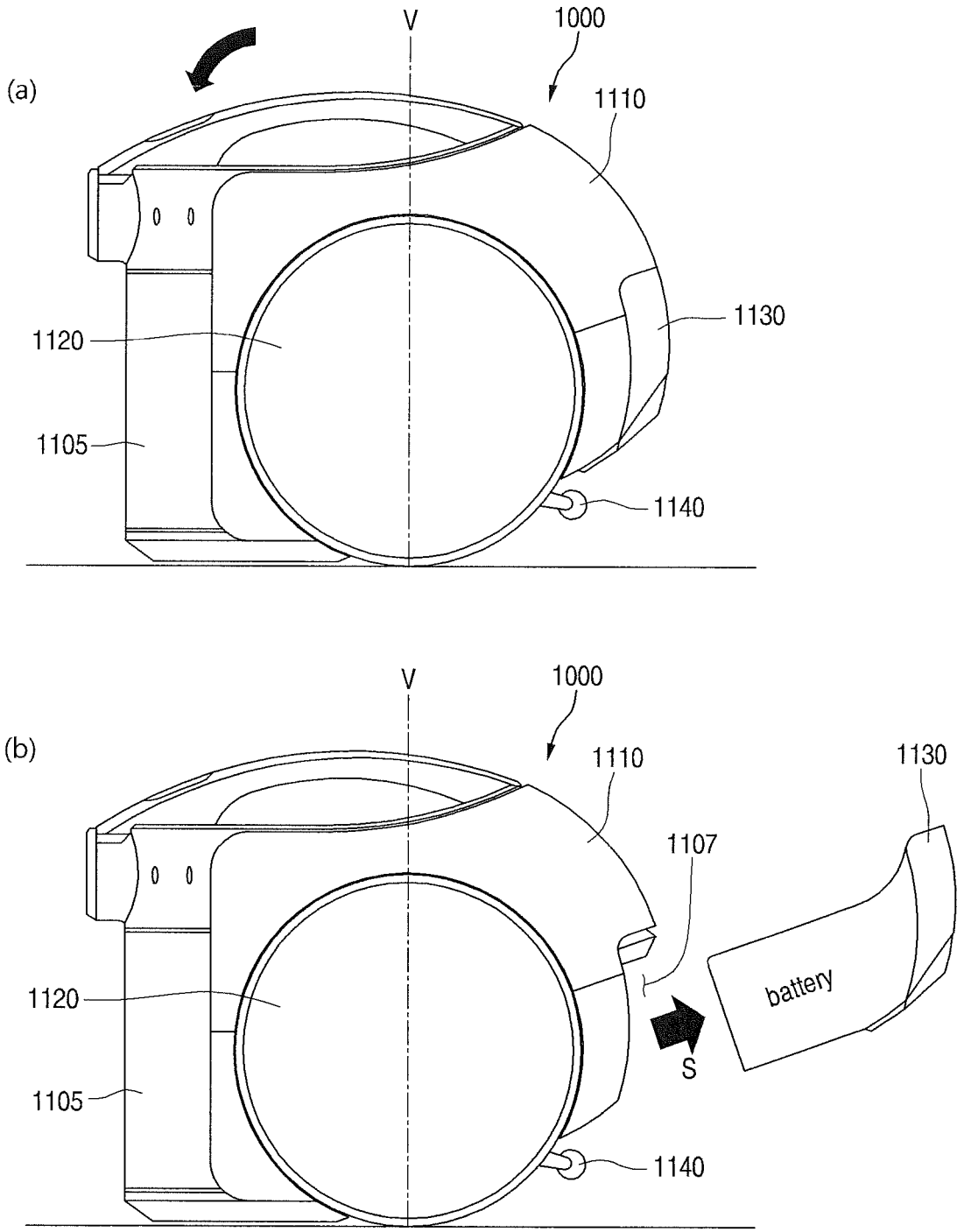
FIG. 14 is a view sequentially illustrating a state where the battery is separated from the cleaner main body.

FIG. 14 is a view sequentially illustrating a state where the battery is separated from the cleaner main body.

Specifically, FIG. 14A is a view illustrating a state before the battery 1130 is separated from the main body portion 1110 and FIG. 14B is a view illustrating a state where the battery 1130 is separated from the main body portion 1110.

In order to separate the battery 1130 from the main body portion 1110, the user is capable of inclining the main body portion 1110 by directly applying a force to the main body portion 1110. Next, the user is capable of separating the battery 1130 in a direction opposite to the insertion direction S.

When the battery 1130 is separated from the main body portion 1110, the center of gravity of the main body portion 1110 moves forward again. Accordingly, the main body portion 1110 is capable of maintaining a forward inclined state.

As described above, in the vacuum cleaner of the present invention, in a state where the battery 1130 is mounted on the main body portion 1110, the main body portion 1110 rotates rearward so that the lower surface portion of the main body portion 1110 is separated from the bottom surface. In other words, the main body portion 1110 is capable of being supported at two points by the moving wheel 1120 when running. In this case, the cleaner main body 1000 is capable of further easily moving over obstacles and since the running friction acting on the movement wheel 1120 is reduced, the user is capable of reducing labor force required for moving the cleaner main body 1000.

Even in a case where the battery 1130 is separated from the main body portion 1110, since the center of gravity of the main body portion 1110 moves forward and the main body portion 1110 rotates forward, the battery coupling portion 1107 provided on the rear lower side of the main body portion 110 rises. Accordingly, the user is capable of easily coupling the battery 1130 to the battery coupling portion 1107.

What is claimed is:

1. A vacuum cleaner, comprising:

a suction hose that is configured to guide dust;

a cleaner main body that is coupled to the suction hose, that is configured to collect dust from the suction hose based on suction force, and that includes:

a main body portion that includes an interior area, a suction motor that is configured to generate suction force, a dust container that is located in the interior area of the main body portion and that includes (i) a storage space to collect dust and (ii) a suction port through which dust is collected from the suction hose into the storage space, and a cover member (i) that is configured to rotate, about an axis that is outside of a plane of the cover member, between a first position and a second position, (ii) that covers, based on the cover member being located at the first position, at least a portion of the dust container, and (iii) that includes a coupling unit that couples the suction hose to the suction port;

a first sealing portion that is coupled to a first end of the coupling unit and that extends at a first angle relative to ground; and a second sealing portion that is coupled to a first end of the suction port and that extends at the first angle relative to ground, wherein, based on the cover member being located at the first position, the first sealing portion is coupled to the second sealing portion and the coupling unit aligns with the suction port.

2. The vacuum cleaner of claim 1, wherein the coupling unit includes:

an inlet portion through which dust is introduced from the suction hose, and an outlet portion from which dust is discharged into the storage space of the dust container, and wherein, based on the cover member being located at the first position, the outlet portion of the coupling unit is coupled to the suction port.

3. The vacuum cleaner of claim 2, further comprising:

a sealing member (i) that is configured to couple the outlet portion of the coupling unit to the suction port and (ii) that is configured to block dust from being scattered outside of the coupling unit or the suction port.

4. The vacuum cleaner of claim 1, wherein, based on the cover member being located at the first position, the coupling unit aligns with the suction hose.

5. The vacuum cleaner of claim 1, wherein the suction hose includes:

a fitting portion that is located at a first end of the suction hose, and wherein at least a portion of the fitting portion is configured to insert into the coupling unit.

6. The vacuum cleaner of claim 5, wherein the coupling unit includes:

a stepped portion on an inside surface of the coupling unit, the stepped portion being configured to (i) hold at least the portion of the fitting portion and (ii) block at least the portion of the fitting portion from being inserted beyond the stepped portion .

7. The vacuum cleaner of claim 1, wherein the dust container includes:

a side surface where, in a state in which the cover member covers at least the portion of the dust container, a first portion of the side surface is exposed to an exterior area of the vacuum cleaner, and wherein an interior area of the dust container is viewable from the exterior area of the vacuum cleaner through the first portion of the side surface.

8. The vacuum cleaner of claim 1, further comprising:

a connecting member that couples the cover member to the main body portion and that is configured to rotate about the axis with the cover member.

9. The vacuum cleaner of claim 1, wherein the cover member includes:

a grip portion that is configured to be gripped by a user to move the cover member between the first position and the second position.

10. The vacuum cleaner of claim 1, wherein the main body portion includes:

a seat portion that accommodates the dust container.

11. A vacuum cleaner, comprising:

a suction hose that is configured to guide dust;

a cleaner main body that is coupled to the suction hose and that includes:

a suction motor that is configured to generate suction force, a dust container that includes a storage space to collect dust, a suction port that couples the suction hose to the dust container and through which dust is collected from the suction hose into the dust container, and a cover member (i) that is configured to rotate, about an axis that is outside of a plane of the cover member, between a first position and a second position and (ii) that covers, based on the cover member being located at the first position, at least a portion of the dust container, the cover member including:

a coupling unit that couples the suction hose to the dust container and that is configured to guide, in a horizontal direction relative to a floor, dust from the suction hose into the storage space of the dust container;

a first sealing portion that is coupled to a first end of the coupling unit and that extends at a first angle relative to ground; and a second sealing portion that is coupled to a first end of the suction port and that extends at the first angle relative to ground, wherein, based on the cover member being located at the first position, the first sealing portion is coupled to the second sealing portion.

12. A vacuum cleaner, comprising:

a suction hose that is configured to guide dust;

a cleaner main body that is coupled to the suction hose and that includes:

a suction motor that is configured to generate suction force, a dust container that includes:

a suction port through which dust is collected from the suction hose into the dust container and that is located on a top surface of the dust container relative to ground, and a cover member (i) that is configured to rotate, about an axis that is outside of a plane of the cover member, between a first position and a second position and (ii) that covers, based on the cover member being located at the first position, at least a portion of the dust container, the cover member including:

a coupling unit including a first end and a second end, the first end being coupled to the suction hose and the second end being coupled to the suction port;

a first sealing portion that is coupled to a first end of the coupling unit and that extends at a first angle relative to ground; and a second sealing portion that is coupled to a first end of the suction port and that extends at the first angle relative to ground, wherein, based on the cover member being located at the first position, the first sealing portion is coupled to the second sealing portion.

13. A vacuum cleaner, comprising:

a suction hose that is configured to guide dust;

a cleaner main body that is coupled to the suction hose and that includes a suction motor that is configured to generate suction force;

a dust container that is located adjacent to the cleaner main body and that includes (i) a side surface, a first portion of the side surface being exposed to an exterior area of the vacuum cleaner, (ii) a storage space to collect dust, and (iii) an opening to the storage space;

a cover member (i) that is configured to rotate, about an axis that is outside of a plane of the cover member, between a first position and a second position and (ii) that covers, based on the cover member being located at the first position, at least a portion of the dust container;

a suction port (i) that is coupled to the opening of the dust container, (ii) that is covered by the cover member based on the cover member being located at the first position, and (iii) that includes a passage through which dust is collected from the suction hose into the storage space of the dust container;

a coupling unit (i) that couples the suction hose to the suction port and (ii) that, based on the cover member being located at the first position, aligns with the suction port such that dust received from the suction hose moves into the passage of the suction port through the coupling unit;

a first sealing portion that is coupled to a first end of the coupling unit and that extends at a first angle relative to ground; and a second sealing portion that is coupled to a first end of the suction port and that extends at the first angle relative to ground, wherein, based on the cover member being located at the first position, the first sealing portion is coupled to the second sealing portion.

14. The vacuum cleaner of claim 13, wherein the second sealing portion has a shape corresponding to a shape of the first sealing portion.

15. The vacuum cleaner of claim 13, wherein the first sealing portion and the second sealing portion are inclined toward the suction port downwardly relative to ground.

16. The vacuum cleaner of claim 13, wherein the first sealing portion and the second sealing portion include an elastic material.

17. The vacuum cleaner of claim 13, wherein the coupling unit, a portion of the suction hose that is coupled to the coupling unit, and the suction port align with each other.

18. The vacuum cleaner of claim 13, wherein the cover member is configured to:

enclose at least the portion of the dust container, and block dust from being scattered outside of the dust container.

19. The vacuum cleaner of claim 13, wherein the cleaner main body includes:

a seat portion that protrudes from a surface of the cleaner main body to accommodate the dust container, and wherein, in a state in which the cover member covers at least the portion of the dust container, a top surface of the dust container is enclosed by the cover member, a bottom surface of the dust container is enclosed by the seat portion, and a side surface of the dust container is exposed to the exterior area of the vacuum cleaner.

* * * * *